United States Patent [19]

Bengtsson

[11] 4,361,184

[45] Nov. 30, 1982

[54] PLATE HEAT EXCHANGER

[75] Inventor: Folke Bengtsson, Stockholm, Sweden

[73] Assignee: Cark Johan Lockmans Ingenjorsbyra AB, Stockholm, Sweden

[21] Appl. No.: 189,927

[22] PCT Filed: May 22, 1979

[86] PCT No.: PCT/SE79/00114

§ 371 Date: Jan. 22, 1980

§ 102(e) Date: Dec. 27, 1979

[87] PCT Pub. No.: WO79/01097

PCT Pub. Date: Dec. 13, 1979

[30] Foreign Application Priority Data

May 22, 1978 [SE] Sweden ..... 7805830

[51] Int. Cl.[3] ..... F28F 3/12

[52] U.S. Cl. ..... 165/165; 165/130; 165/170

[58] Field of Search ..... 165/164–167, 165/170, 130

[56] References Cited

U.S. PATENT DOCUMENTS

| | | | |
|---|---|---|---|
| 552,643 | 1/1896 | Jaennigen | 165/130 |
| 1,823,788 | 9/1931 | Dewoitine | 165/170 |
| 2,779,086 | 1/1957 | Rieppel et al. | 165/170 X |
| 2,874,942 | 2/1959 | Rieppel et al. | 165/170 |
| 3,141,500 | 7/1964 | Raskin | 165/170 |
| 3,424,238 | 1/1969 | Leeds et al. | 165/170 X |

FOREIGN PATENT DOCUMENTS

| | | | |
|---|---|---|---|
| 698457 | 1/1931 | France | 165/130 |
| 485095 | 9/1953 | Italy | 165/170 |
| 115289 | 9/1968 | Norway | 165/170 |
| WO79/01097 | 12/1979 | PCT Int'l Appl. | 165/165 |
| 15096 | of 1895 | United Kingdom | 165/165 |
| 222445 | of 1925 | United Kingdom | 165/170 |
| 642590 | 1/1979 | U.S.S.R. | 165/ |

*Primary Examiner*—Sheldon J. Richter
*Attorney, Agent, or Firm*—Holman & Stern

[57] ABSTRACT

The invention relates to a plate heat exchanger, which comprises a plurality of plates (1) arranged to the side of each other, each plate consisting of two metal sheets (2,3), which are welded one to the other along two parallel edges and have longitudinal bulgings in parallel with said edges. The invention has the object to produce a plate heat exchanger where the medium flowing within the plate is guided in a direction in parallel with the extension of the bulgings and back in the same direction. Each plate (1) is formed with a turning zone in that the bulgings in pairs meet in such a manner, that in the sheet plane two outermost bulgings meet along a semicircle line, thereafter the two bulgings next to the outermost ones, a.s.o., and the number of bulgings is an integer number.

2 Claims, 3 Drawing Figures

PLATE HEAT EXCHANGER

BACKGROUND OF THE INVENTION

This invention relates to a plate heat exchanger, which comprises a plurality of plates arranged to the side of each other and each consisting of two metal sheets, which are welded one to the other along two parallel edges and have longitudinal bulgings in parallel with said edges. The present invention has the object to produce a plate heat exchanger where the medium flowing within the plate is guided in a direction in parallel with the extension of the bulgings and back in the same direction. This arrangement implies the further gain that substantially all surfaces of the plates flowed through by a medium participate in the heat exchange. This is not the case, for example, when at one end of the plate a box is used for turning the medium flowing through the plates.

BRIEF DESCRIPTION OF THE DRAWINGS

In order to achieve the aforesaid object, the invention has been given the characterizing features defined in the attached claims. An embodiment of the invention is described in the following, with reference to the accompanying drawings, in which

DETAILED DESCRIPTION OF THE PREFERRED EMBODIMENTS

Figure 1:
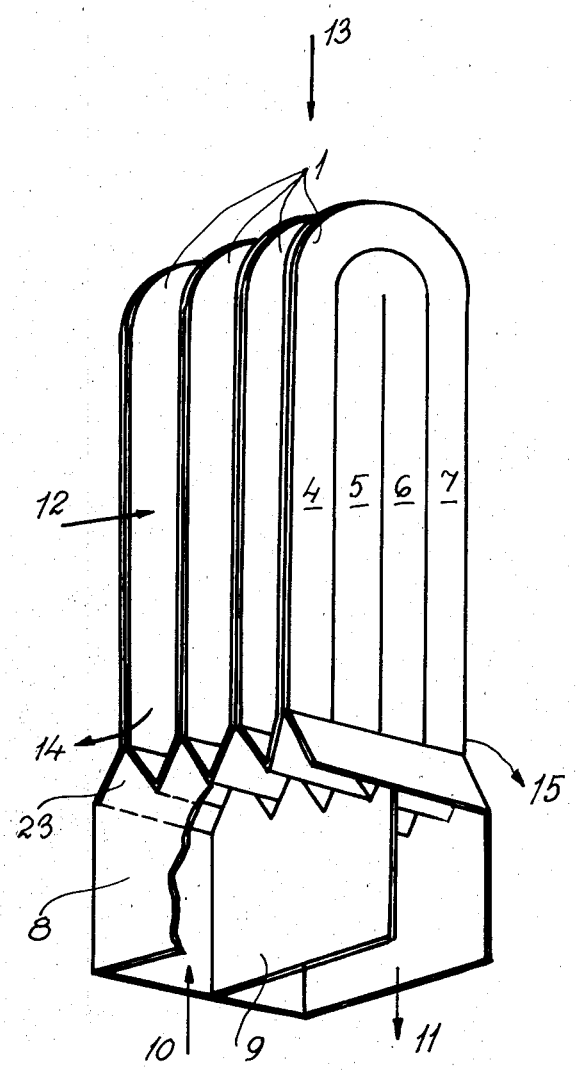
FIG. 1 is a perspective view seen obliquely from below of four plates with associated intakes, the casing about the heat exchanger being omitted.

FIG. 1, thus, shows in a perspective way four plates, which are arranged to the side of each other and provided with an intake. The plates 1 at the embodiment shown are four in number and assembled of two metal sheets 2 and 3 so as to form a hollow flow body, see FIG. 2. Each plate has four passages 4, 5, 6 and 7. At the upper end of the plates a turning zone is formed so that the passage 4 turns into the passage 7, and the passage 5 turns into the passage 6. The design of the passages will become apparent in greater detail from the following. At the lower edge of the plates a distribution connecting piece 8 is attached, within which a partition sheet 9 is located to separate the passages 4 and 5 from the passages 6 and 7. A medium is hereby caused to flow into the plates according to arrow 10 and out of the plates according to arrow 11. In FIG. 1 the distribution connecting piece 8 is shown on an enlarged scale relative to the plates in order to simplify the illustration. The length of the plates 1, of course, can be varied entirely as desired in respect of the size of the heat surfaces. The second medium participating in the heat exchange flows between the plates 1, for example according to arrow 12. The flow path may also be from above according to arrow 13 and thereafter outward at the arrows 14 and 15. A casing of sheet metal is then placed about the plate package with an inlet provided at the upper edge and one or several outlets provided close to the areas marked by the arrows 14 and 15.

Figure 2:
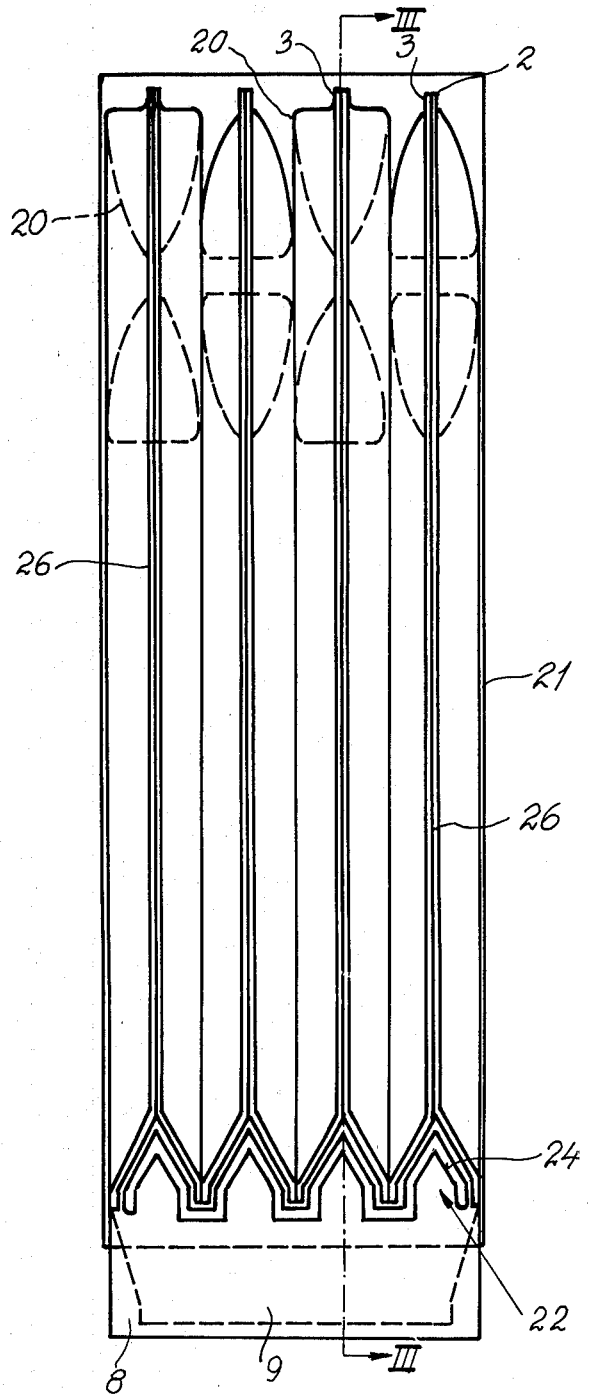
FIG. 2 is a lateral view on an enlarged scale of the plates seen against the edge joints of the plates.
Figure 3:
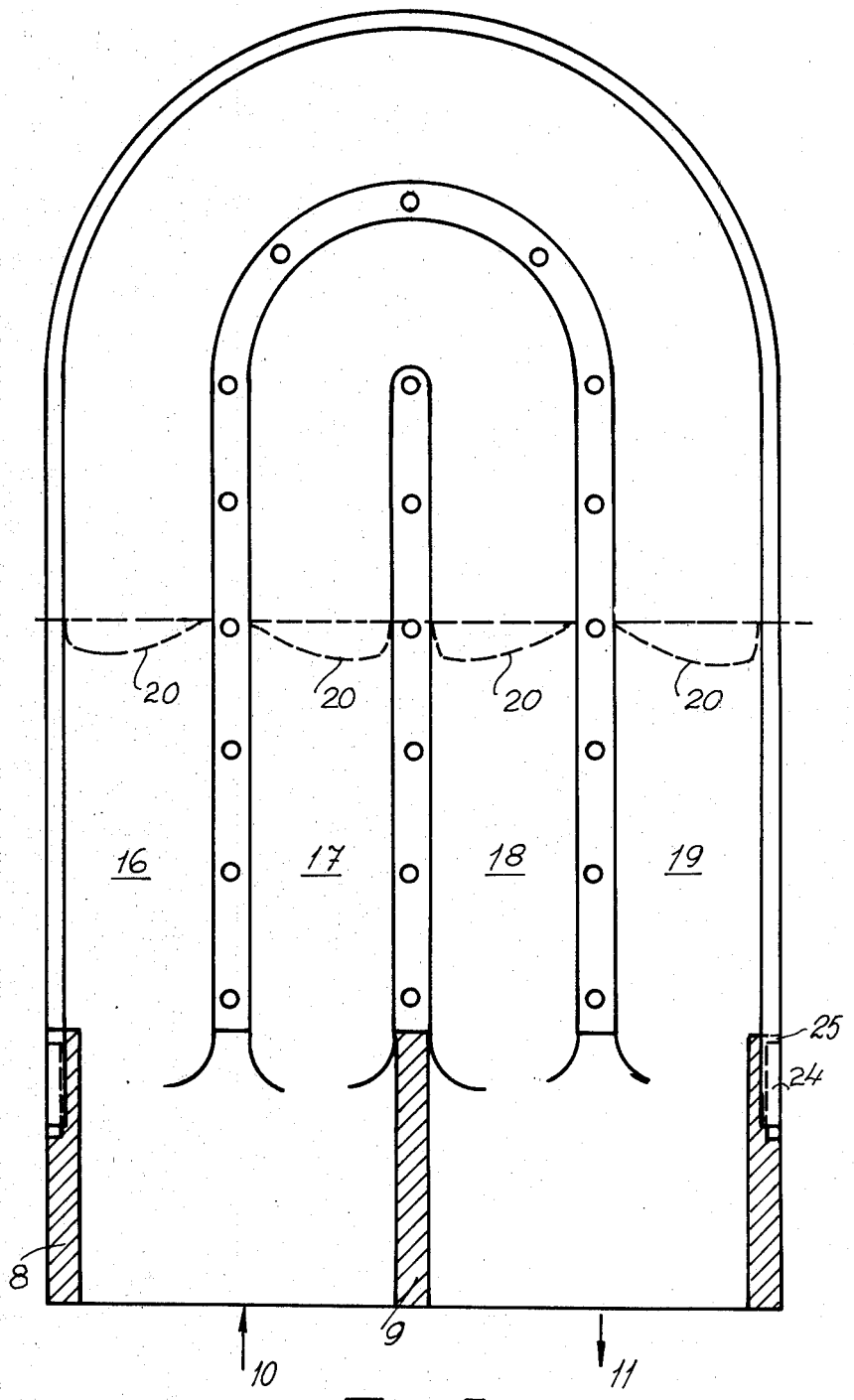
FIG. 3 is a section along the line III—III in FIG. 2 and, thus, a horizontal view of a metal sheet comprised in a plate.

FIGS. 2 and 3 illustrate the structure of the plates and of the metal sheets constituting the same. FIG. 3 is a section along the line III—III in FIG. 2 and, thus, may be said to illustrate a metal sheet 3 seen from the inside. The metal sheet has longitudinal bulgings 16, 17, 18 and 19, which may consist of valleys of symmetric shape, for example a portion of an arc. In FIGS. 2 and 3 a special shape is shown where the valleys have a cross-sectional shape resembling half a pear, see the dashed lines 20. This shape, thus, is asymmetric relative to a central line in the valley. In order to render it possible, for example, for the passages 16 and 19 to meet in the turning zone, i.e. at the upper end of the plates, the asymmetric shape for the passages 16 and 19 must be identical but reversed, as also appears from FIG. 3.

The cross-sectional shape of the valley 17 is equal but reversed to that of the valley 16, and the cross-sectional shape for the valley 18 is reversed relative to the cross-sectional shape for the valley 17. A cross-section along the line II—II in FIG. 3 thereby yields the dashed lines in the upper part of FIG. 2 which are designated by 20 in order to make it understood that they are in agreement with the dashed lines 20 in FIG. 3. In FIG. 3, thus, an underlying metal sheet with the valleys 16–19 is shown. In order to obtain a plate, an overlying metal sheet formed with corresponding valleys is placed thereon. When the metal sheets are positioned one against the other, the valleys are closed and form passages. In each plate, thus, four passages 4–7 according to FIG. 1 are formed. The cross-sectional shape of the passages in the turning zone is apparent from the dashed lines in the upper part of FIG. 2.

In FIG. 2, the numeral 21 designates a sheet metal casing about the plate package, and in said casing the medium is included whith flows about and between the plates.

The distribution connecting piece 8 is shown in FIG. 3 by a cross-section through the lateral walls and also a cross-section through the partition wall 9. For connecting the side walls in the distribution connecting piece 8 to the plates, the lower edges of the plates have been flattened, so that a cross-section through the plate has V-shape. Said V-shape 22, which appears from FIGS. 1 and 2, implies that the plates have a V-shaped opening with straight edges. The sides 8 are cut open to corresponding V-shape, so that "teeth" 23 are formed which are welded on corresponding edges of the plates. The walls 8 preferably are designed with substantial thickness, and in the "teeth" 23 recesses 24 with corresponding V-shape are made, so that an upright edge 25 extending in V-shape is formed. Said edge 25 abuts the free edge of the plates, and owing to the edge 25 projecting from the side 8 the possibility of welding to the lateral edge of the plate is improved. The plates in general are jointed all about along the edges 26.

The structure has a good strength, and high temperature differences can be permitted. The plates bend only slightly, and attachments in turning boxes or the like are not affected.

The flow function of the medium flowing in the plates is shown in FIG. 1. The medium flows in at arrow 10, is distributed in the passages 4 and 5, flows upward to the upper end of the plates, turns in the so-called turning zone, flows back in the passages 6 and 7 and out through the distribution connecting piece 8 according to arrow 11. See also FIG. 3. The medium flowing outside the plates can be guided in that a gasket strip, for example of teflon, is laid in between the outer surfaces of two plates along the valley line between the passages 5 and 6, i.e. between the valleys 17 and 18.

Hereby a pure countercurrent between the media can be obtained.

I claim:

1. A plate heat exchanger, comprising:

a plurality of plates exposed to a first heat exchange medium and arranged face-to-face, each plate including a heat exchange portion carrying a second heat exchange medium, said portion having a first zone defining "2n" longitudinally extending, distinct, tubular bulgings, and a second zone having "n" distinct tubular bulgings disposed in concentric semicircles at an end of the plate, whereby "n" is an integer, said heat exchange portion consists of first and second zones, said first and second zones mate so that the the two outermost bulgings in the first zone are interconnected by the outermost bulgings in the second zone, the next two outermost bulgings in the first zone are interconnected by the next outermost bulging in the second zone, seriatim, said bulgings being connected in pairs, being curvilinear and asymmetric in cross-section, and adjacent ones are reversed relative to each other, and heat exchange is effected between said first and second media when said second medium is caused to flow through said bulgings in said plates.

2. A plate heat exchanger as defined in claim 1 wherein said curvilinear cross-section of said bulgings defines a substantially triangular shape.

* * * * *